United States Patent [19]

Uchida et al.

[11] Patent Number: 4,459,213

[45] Date of Patent: Jul. 10, 1984

[54] FIRE-EXTINGUISHER COMPOSITION

[75] Inventors: Yasuzo Uchida; Sadayuki Kawai; Koichi Sugita, all of Tokyo; Hitoshi Nagasaki; Yoichi Shirakawa, both of Urawa, all of Japan

[73] Assignee: Secom Co., Ltd., Tokyo, Japan

[21] Appl. No.: 454,594

[22] Filed: Dec. 30, 1982

[51] Int. Cl.[3] ..... A62D 1/00

[52] U.S. Cl. ..... 252/8.05; 252/2

[58] Field of Search ..... 252/2, 8.05

[56] References Cited

U.S. PATENT DOCUMENTS 2,902,446 9/1959 Mitchell et al. ..... 252/8.05 X 3,968,060 7/1976 Vincent et al. ..... 252/2 X

FOREIGN PATENT DOCUMENTS 53-145398 12/1978 Japan ..... 252/2

*Primary Examiner*—Leland A. Sebastian

*Attorney, Agent, or Firm*—Armstrong, Nikaido, Marmelstein & Kubovcik

[57] ABSTRACT

A fire-extinguisher composition comprising a blend of at least one member selected from the group consisting of protein and protein decomposition products, at least one liquid polyhydroxy compound or an aqueous solution of at least one polyhydroxy compound, and at least one halogenated hydrocarbon. The composition can easily be emulsified or dispersed in water and exhibits a high retention of its fire-extinguishing ability, a satisfactory secondary fire-extinguishing ability, and a foaming ability sufficient to make a foaming device unnecessary.

10 Claims, No Drawings

FIRE-EXTINGUISHER COMPOSITION

BACKGROUND OF THE INVENTION

1. Field of the Invention

The invention relates to a halogenated hydrocarbon fire-extinguisher composition having an improved performance, such as an enhanced fire-extinguishing ability and retention of the fire-extinguishing ability.

2. Description of the Prior Art

Halogenated hydrocarbon fire-extinguishing agents having a negative catalytic activity have recently been developed and, further, have been increasingly employed in fire-extinguishing equipment because halogenated hydrocarbon fire-extinguishing agents exhibit a high fire-extinguishing ability when used in a small amount, are effective for a large area, and cause no secondary contamination.

When halogenated hydrocarbon fire-extinguishing agents are used to extinguish a fire, a fire-extinguishing gas is emitted near the object to be extinguished. Thus, these agents can attain a satisfactory fire-extinguishing effect in a closed room. However, fire-extinguishing is difficult in a small area within a large closed space, in a room with an open door or window (i.e., a room having an opening), or outdoors since the fire-extinguishing gas is inevitably widely diffused or dissipated. On the other hand, aqueous-film foam fire-extinguishing agents (e.g., Light Water) are predominantly used to extinguish an oil surface fire but cannot be employed to extinguish a fire in an architectural structure such as a building. Thus, they cannot be flexibly used.

Further, foam fire-extinguishing agents comprised of protein or a surface-active agent are known but need to be improved in regard to the length of time the formed foam remains on the surface of the burning material, i.e., retention of the foam film. In addition, these foam fire-extinguishing agents need to be improved so that they do not necessitate the provision of a foaming device in the fire-extinguishing liquid-emitting portion of foam fire-extinguishing equipment.

Furthermore, there have been proposed, for example, in Japanese Unexamined Patent Publication (Kokai) Nos. 52-144193 and 52-144195 and Japanese Examined Patent Publication (Kokoku) No. 52-33919, halogenated hydrocarbon fire-extinguishing agents in which a halogenated hydrocarbon is dissolved or emulsified in water with a surface-active agent or a halogenated hydrocarbon is mixed with an aqueous solution of a surface-active agent. However, these halogenated hydrocarbon fire-extinguishing agents have the same drawbacks as the above-mentioned foam fire-extinguishing agents.

SUMMARY OF THE INVENTION

The inventors made extensive studies for the purpose of obtaining the above-mentioned needed improvements and found that a fire-extinguisher composition having very advantageous properties, i.e., a high retention of its fire-extinguishing ability, a satisfactory secondary fire-extinguishing ability, and a foaming ability sufficient to make a foaming device unnecessary, can be obtained by blending a halogenated hydrocarbon with specific substances.

Thus, the present invention provides a fire-extinguisher composition comprising a blend of at least one member selected from the group consisting of protein and protein decomposition products, at least one liquid polyhydroxy compound or an aqueous solution of at least one polyhydroxy compound, and at least one halogenated hydrocarbon.

The fire-extinguisher composition of the present invention can easily be emulsified or dispersed in water and exhibits an excellent fire-extinguishing characteristic.

In the blend according to the present invention, it is preferable that the halogenated hydrocarbon be emulsified, micro-mulsified, or dissolved in the liquid polyhydroxy compound or in an aqueous solution of the polyhydroxy compound to form a homogeneous liquid, paste or solid mixture.

DESCRIPTION OF THE PREFERRED EMBODIMENTS

The protein usable for the present invention may include sodium caseinate, soybean protein, skimmed milk, whey powder, egg albumen, dried egg albumen, blood powder, meat powder, microorganism protein, peptone, yeast extract, albumin, lactalbumin, globulin, lactoglobulin, glutelin, protamine, and histamine. As the protein decomposition products, there may be employed products obtained from the decomposition of the above-mentioned protein with protease, acids, or the like.

The polyhydroxy compound usable for the present invention may include divalent alcohols such as prpylene glycol, trivalent alcohols such as glycerol, sugar alcohols such as sorbitol and mannitol, monosaccharides such as glucose and fructose, oligosaccharides such as di-, tri-, or tetra-saccharides, e.g., sucrose, maltose, and galactose, invert sugar obtained by the hydrolysis of starch, oxidized sugar, isomerized dextrin, syrup, honey, and jam. The liquid polyhydroxy compound may include polyhydroxy compounds, in a liquid state at room temperature, selected from the above-mentioned polyhydroxy compounds, and, for example, propylene glycol and glycerol may be employed as the liquid polyhydroxy compound.

Examples of the halogenated hydrocarbon are halogenated methanes such as carbon tetrachloride, chlorobromomethane, chlorodifluoromethane, bromochlorodifluoromethane, bromotrifluoromethane, trichlorofluoromethane, bromotrichloromethane, dibromodichloromethane, tribromochloromethane, bromodichlorofluoromethane, dibromochlorofluoromethane, tribromofluoromethane, dibromodifluoromethane, bromodichloromethane, dibromochloromethane, tribromomethane, bromochlorofluoromethane, dibromofluoromethane, bromodifluoromethane, dibromomethane, bromofluoromethane, and bromomethane, halogenated ethanes such as hexachloroethane, hexafluoroethane, dibromotetrafluoroethane, tetrachlorodifluoroethane, trichlorotrifluoroethane, dichlorotetrafluoroethane, chloropentafluoroethane, pentachloroethane, tetrachlorofluoroethane, trichlorodifluoroethane, dichlorotrifluoroethane, chlorotetrafluoroethane, pentafluoroethane, tetrachloroethane, trichlorofluoroethane, dichlorodifluoroethane, chlorotrifluoroethane, tetrafluoroethane, trichloroethane, dichlorofluoroethane, chlorodifluoroethane, trifluoroethane, dichloroethane, chlorofluoroethane, difluoroethane, and fluoroethane, halogenated ethylenes such as tetrachloroethylene, trichlorofluoroethylene, dichlorodifluoroethylene, chlorotrifluoroethylene, tetrafluoroethylene, trichloroethylene, dichlorofluoroethylene, chlorodifluoroethylene, trifluoroethylene, dichloroethylene, chlorofluoroethylene, and difluoroethylene, halogenated propanes or propylenes such as octafluoropropane and hexafluoropropylene, and halogenated cyclic hydrocarbons such as hexafluorocyclopropane, tetrachlorotetrafluorocyclobutane, and dichlorohexafluorocyclobutane. Particularly preferred halogenated hydrocarbons are those having 1 to 4 carbon atoms and a boiling point of −50° C. to 150° C.

In the fire-extinguisher composition of the present invention, the protein and/or protein decomposition products may preferably be contained in an amount of not less than 0.005% by weight, more preferably not less than 0.05% by weight, and especially not less than 5% by weight based on the total weight of the protein and/or protein decomposition products and the polyhydroxy compound(s), and the polyhydroxy compound(s) may preferably be contained in an amount of not less than 30% by weight, more preferably not less than 40% by weight, and even up to approximately 100% by weight in the case of the liquid polyhydroxy compound(s), based on the total weight of the protein and/or protein decomposition products and the polyhydroxy compound(s). On the other hand, the halogenated hydrocarbon(s) may preferably be contained in an amount of 35% to 90% by weight, more preferably 40% to 70% by weight based on the total weight of the blend of which the composition of the present invention is comprised.

The fire-extinguisher composition according to the present invention may further contain a surface-active agent. It is advantageous if the composition contains a surface-active agent because a surface-active agent imparts an enhanced foaming ability and foam stability to the composition. As the surface-active agent, there may be used various types of surface-active agents such as anionic, nonionic, cationic, and ampholytic surface-active agents. Examples of anionic surface-active agents are carboxylates such as soap, N-acylamino acid salts, alkyl ether carboxylate, and acylated peptide, sulfonates such as alkylsulfonates, alkylbenzenesulfonates, alkylnapthalenesulfonates and formalin condensates thereof, dialkylsulfosuccinic acid ester salts, α-olefinsulfonates, and N-acylmethyltaurines, sulfuric acid ester salts such as aulfonated oils, alkylsulfates, alkyl ether sulfates, alkylallyl ether sulfates, and alkylamidosulfates, and phosphoric acid ester salts such as alkylphosphates, alkyl ether phosphates, and alkylallyl ether phosphates. Examples of nonionic surface-active agents are ether-type surface-active agents such as polyoxyethylene alkyl ethers, polyoxyethylene secondary alkyl ethers, polyoxyethylene alkylphenyl ethers, ethylene oxide derivatives of alkylphenol-formalin condensates, and polyoxyethylene-polyoxypropylene block polymers, ether ester-type surface-active agents such as polyeoxyethylene glycerol fatty acid esters, polyoxyethylene caster oils and hardened caster oils, polyoxyethylene sorbitan fatty acid esters, and polyoxyethylene sorbitol fatty acid esters, ester-type surface-active agents such as polyoxyethylene glycol fatty acid esters, fatty acid monoglycerides, sorbitan fatty acid esters, and sucrose fatty acid esters, and nitrogen-containing surface-active agents such as fatty acid alkanolamides, polyoxyethylene fatty acid amides, polyoxyethylene alkylamines, and alkylamine oxides. Examples of cationic surface-active agents are alkylamine salts, quaternary ammonium salts, benzalkonium salts, benzethonium chloride, and pyridinium salts. Examples of ampholytic surface-active agents are carboxybetaines, sulfobetaines, aminocarboxylates, imidazoliniumbetaine, and lecithin. Further, fluorine surface-active agents and silicone surface-active agents may also be employed.

The fire-extinguisher composition according to the present invention may further contain, in addition to the above-mentioned components, various other components such as inorganic fire-extinguishing agents, e.g., bicarbonates and phosphates, organic fire-extinguishing agents, e.g., organic phosphorus compounds, thickening agents, e.g., sodium alginate, carboxymethylcellulose, and polyoxyethylene oxide, colorants, perfume, antiseptics, germicides, rust preventives, and other organic or inorganic substances.

The fire-extinguisher composition of the present invention may be prepared by blending at least one member selected from the protein and protein decomposition products, at least one liquid polyhydroxy compound or an aqueous solution of at least one polyhydroxy compound, and at least one halogenated hydrocarbon. Preferably, the fire-extinguisher composition is prepared by blending one or more protein and/or protein decomposition products with one or more liquid polyhydroxy compounds or an aqueous solution of one or more polyhydroxy compounds at room temperature or at an elevated temperature to form a homogeneous mixture and then slowly adding, optionally at a low temperature or under pressure, one or more halogenated hydrocarbons to the mixture while stirring it so as to again form a homogeneous mixture.

When the fire-extinguisher composition of the present invention is in a liquid form, it can be used as such. However, it is generally preferable that the composition be used by being emulsified or dispersed in water. If the fire-extinguisher composition is converted into an aqueous fire-extinguishing liquid by being emulsified or dispersed in water, it is preferable that the fire-extinguisher composition be diluted with water so that the resultant fire-extinguishing liquid contains 10% to 50% by weight of the halogenated hydrocarbon(s).

Preferably, the fire-extinguisher composition according to the present invention is used by blending a blend of at least one member selected from the protein and protein decomposition products, at least one liquid polyhydroxy compound or an aqueous solution of at least one polyhydroxy compound, and at least one halogenated hydrocarbon, or an aqueous emulsion or dispersion of the blend, with a blend of at least one surface-active agent, at least one liquid polyhydroxy compound or an aqueous solution of at least one polyhydroxy compound, and at least one halogenated hydrocarbon or an aqueous emulsion or dispersion of the blend.

The fire-extinguisher composition according to the present invention can be converted into a fire-extinguishing liquid by blending it with water, and, therefore, it can be used to extinguish various types of fires since it can easily be emulsified or dispersed in water. In addition, the composition or the fire-extinguishing liquid can be foamed, without using a foaming device, so that it exhibits a foam fire-extinguishing effect, with the halogenated hydrocarbon gas being retained in the foam. Further, since the formed foam is highly durable over a long period of time, the composition exhibits a higher fire-extinguishing effect than does a composition containing only a halogenated hydrocarbon and also exhibits a high retention of its fire-extinguishing ability and a satisfactory secondary fire-extinguishing ability and thereby can be used in a smaller amount than can a composition containing only a halogenated hydrocarbon. The fire-extinguisher composition has a further advantage in that fire extinguishing is possible in a small area with in an open space, which fire extinguishing is difficult according to the conventional fire-extinguishing method, in which only a halogenated hydrocarbon is emitted.

The present invention will further be illustrated by the following non-limitative examples. In the examples, all parts are by weight.

EXAMPLE 1

A total of 1.5 parts of sodium caseinate was slowly added, while stirring the mixture, to 28.5 parts of glycerin heated to 70° C. to 80° C. so as to uniformly dissolve or disperse the sodium caseinate in the glycerin. After the mixture was cooled, 70 parts of dibromotetrafluoroethane (HALON 2402) was added dropwise to obtain a fire-extinguisher composition of a homogeneous mixture.

The obtained fire-extinguisher composition was easily emulsified or dispersed in water to form homogeneous fire-extinguishing liquids of various concentrations, shown in Table 1 below. The resultant fire-extinguishing liquids were then subjected to a test.

Test Method

Gasoline was charged to a depth of 15 mm into a pan having a diameter of 260 mm and a depth of 70 mm and then was ignited. The fire was extinguished by spraying, at a constant rate, an aqueous fire-extinguisher liquid onto the fire with an atomizer capable of spraying 12.5 cc of liquid per stroke, and the time and the amount of the fire-extinguishing liquid necessary to completely extinguish the fire were determined.

The obtained results are shown in Table 1.

TABLE 1

| Run No. | Concentration of HALON in Fire-extinguishing Liquid | Fire-extinguishing Time (sec.) | Amount of Fire-estinguishing Liquid (cc) | Amount of Used HALON (cc) |
|---|---|---|---|---|
| 1 | 0 (100% water) | Not extinguished | 250 | 0 |
| 2 | 2 | Not extinguished | 250 | 5 |
| 3 | 4 | Not extinguished | 250 | 10 |
| 4 | 5 | Not extinguished | 250 | 12.5 |
| 5 | 8 | Not extinguished | 250 | 20 |
| 6 | 10 | 9 | 225 | 22.5 |
| 7 | 15 | 5 | 225 | 34 |
| 8 | 20 | 15 | 200 | 40 |
| 9 | 30 | 15 | 175 | 52.5 |
| 10 | 50 | 5 | 87.5 | 44 |
| 11 | 100 (no water) | 5 | 40 | 40 |

As can be seen from run No. 1, the fire was not extinguished when water only was used but was extinguished when 40 cc of 100% HALON (run No. 11) was used. However, in the case of 100% HALON, when a flame was applied to the gasoline immediately after the fire was extinguished, the gasoline ignited, proving that 100% HALON is not suitable for extinguishing a fire in a small area within an open space. Contrary to this, the fire was extinguished with a fire-extinguishing liquid containing the fire-extinguisher composition according to the present invention in an amount of only 22.5 cc (about half of the used amount of 100% HALON). It is believed that this result was due to the synergistic effect of foaming the fire-extinguishing liquid in addition to the fire-extinguishing effect of HALON. Further, in the case of the composition of the present invention, the gasoline did not re-ignite when a flame was applied thereto 5 minutes after the fire was extinguished, proving that the fire-extinguishing liquid containing the composition of the present invention has an excellent ability to prevent re-ignition of a fire and thus is suitable for extinguishing a fire in a small area with in an open space.

EXAMPLE 2

A total of 1.5 parts of sodium caseinate was slowly added, while stirring the mixture, to 38.5 parts of a 75% aqueous sugar solution so as to uniformly dissolve the sodium caseinate in the sugar solution. Then 60 parts of a homogeneous mixture of 30 parts of dibromotetrafluoroethane (HALON 2402) and 30 parts of carbon tetrachloride was slowly added dropwise to the mixture so as to obtain a fire-extinguisher composition of a homogeneous mixture.

The obtained fire-extinguisher composition was easily emulsified or dispersed in water so as to form homogeneous fire-extinguishing liquids of various concentrations, shown in Table 2 below. The resultant fire-extinguishing liquids were subjected to the same type of fire-extinguishing test as that in Example 1.

The results are shown in Table 2.

TABLE 2

| Run No. | Concentration of HALON in Fire-extinguishing Liquid | Fire-extinguishing Time (sec.) | Amount of Fire-extinguishing Liquid (cc) | Amount of Used HALON (cc) |
|---|---|---|---|---|
| 1 | 0 (100% water) | Not extinguished | 250 | 0 |
| 2 | 8 | Not extinguished | 250 | 20 |
| 3 | 10 | Not extinguished | 250 | 25 |
| 4 | 12 | 10 | 220 | 26.4 |
| 5 | 15 | 8 | 220 | 33 |
| 6 | 20 | 5 | 200 | 40 |
| 7 | 100 (no water) | 7 | 50 | 50 |

EXAMPLE 3

To a stirred solution of 20 parts of glycerin in 18.5 parts of water, 1.5 parts of sodium caseinate was slowly added was so as to uniformly dissolve the sodium caseinate in the solution. Then 60 parts of dibromotetrafluoroethane (HALON 2402) was slowly added dropwise to the mixture so as to obtain a fire-extinguisher composition A of a homogeneous mixture.

A total of 2.5 parts of sodium dodecylbenzenesulfonate was uniformly dissolved in a solution of 30 parts of glycerin in 75 parts of water. Then 60 parts of dibromotetrafluoroethane (HALON 2402) was slowly added dropwise to the mixture so as to obtain a fire-extinguisher composition B of a homogeneous mixture.

The fire-extinguisher compositions A and B were mixed at a weight ratio of 1:1 and then were emulsified or dispersed in water so as to form homogeneous fire-extinguishing liquids of various concentrations, shown in Table 3 below. Then the resultant fire-extinguishing liquids were subjected to the same fire-extinguishing test as that in Example 1.

The results are shown in Table 3.

TABLE 3

| Run No. | Concentration of HALON in Fire-extinguishing Liquid | Fire-extinguishing Time (sec.) | Amount of Fire-extinguishing Liquid (cc) | Amount of Used HALON (cc) |
|---|---|---|---|---|
| 1 | 0 (100% water) | Not extinguished | 250 | 0 |
| 2 | 2 | Not extinguished | 250 | 5 |
| 3 | 4 | 9 | 225 | 10 |
| 4 | 5 | 9 | 210 | 10.5 |
| 5 | 8 | 8 | 200 | 16 |
| 6 | 10 | 6 | 200 | 20 |
| 7 | 15 | 5 | 150 | 22.5 |
| 8 | 20 | 3 | 100 | 20 |
| 9 | 30 | 3 | 75 | 22.5 |
| 10 | 50 | 3 | 50 | 25 |
| 11 | 100 (no water) | 5 | 40 | 40 |

We claim:

1. A fire-extinguisher composition comprising a blend of at least one member selected from the group consisting of protein and protein decomposition products, at least one liquid polyhydroxy compound or an aqueous solution of at least one polyhydroxy compound, and at least one halogenated hydrocarbon.

2. At fire-extinguisher composition as claimed in claim 1, wherein at least one member selected from the group consisting of protein and protein decomposition products is contained in an amount of not less than 0.005% by weight based on the total weight of said at least one member selected from said group consisting of protein and protein decomposition products and said at least one polyhydroxy compound.

3. A fire-extinguisher composition as claimed in claim 2, wherein the amount of said member is not less than 0.05% by weight.

4. A fire-extinguisher composition as claimed in claim 3, wherein the amount of said member is not less than 5% by weight.

5. A fire-extinguisher composition as claimed in claim 1, wherein at least one polyhydroxy compound is contained in an amount of not less than 30% by weight based on the total weight of said at least one member selected from said group consisting of protein and protein decomposition products and said at least one polyhydroxy compound.

6. A fire-extinguisher composition as claimed in claim 5, wherein the amount of said polyhydroxy compound is not less than 40% by weight.

7. A fire-extinguisher composition as claimed in claim 1, wherein at least one halogenated hydrocarbon is contained in an amount of 35% to 90% by weight based on the total weight of said blend.

8. A fire-extinguisher composition as claimed in claim 7, wherein the amount of said halogenated hydrocarbon is from 40% to 70% by weight.

9. A fire-extinguisher composition as claimed in claim 1, further comprising at least one surface-active agent.

10. A fire-extinguisher composition comprising, emulsified or dispersed in water, a blend of at least one member selected from the group consisting of protein and protein decomposition products, at least one liquid polyhydroxy compound or an aqueous solution of at least one polyhydroxy compound, and at least one halogenated hydrocarbon.

* * * * *